United States Patent [19]

Mendoza

[11] 3,930,878

[45] Jan. 6, 1976

[54] METHOD AND APPARATUS FOR REDUCING STARCH-CONTAINING MATERIAL TO FLOUR

[76] Inventor: Fausto Celorio Mendoza, Cumbres de Acultzingo No. 185, Lomas de Chapultepec, Mexico, 10, D.F.

[22] Filed: Apr. 22, 1974

[21] Appl. No.: 462,798

Related U.S. Application Data

[63] Continuation-in-part of Ser. No. 392,625, Aug. 29, 1973, abandoned.

[30] Foreign Application Priority Data

Nov. 27, 1972 Mexico ..... 139970
Mar. 2, 1973 Mexico..... 141691

[52] U.S. Cl. ..... 127/67; 127/32; 241/6; 241/245; 241/257 R; 241/259.1; 241/260; 241/261.1

[51] Int. Cl.[2] ..... B02C 2/00; C13L 1/08

[58] Field of Search..... 127/23, 24, 32, 67; 241/6, 241/245, 248, 257 R, 259.1, 260, 261.1; 426/622

[56] References Cited

UNITED STATES PATENTS

| | | | |
|---|---|---|---|
| 333,369 | 12/1885 | Wilkeson | 241/261.1 X |
| 1,021,950 | 4/1912 | Shepard | 241/261.1 X |
| 1,851,071 | 3/1932 | Travis | 241/245 |
| 1,885,283 | 11/1932 | Ostermann | 241/245 X |
| 2,653,770 | 9/1953 | Vicci | 241/245 X |
| 2,744,826 | 5/1956 | Thompson | 426/622 |
| 2,749,814 | 6/1956 | Haug | 241/257 R |
| 3,008,505 | 11/1961 | Pavia | 241/260 X |
| 3,285,524 | 11/1966 | Stratford | 241/259.1 |
| 3,305,183 | 2/1967 | Morden | 241/261.1 X |
| R26,256 | 8/1967 | Protzman | 127/23 X |

*Primary Examiner*—Morris O. Wolk
*Assistant Examiner*—Sidney Marantz
*Attorney, Agent, or Firm*—Albert L. Jeffers; Roger M. Rickert

[57] ABSTRACT

Method and apparatus for converting grains, beans, and like materials into flour, as highly water absorbent starch. The material is introduced into the annular gap between a stationary outer truncated cone member and an inner rotating truncated cone member. The cone members are on a vertical axis, smaller ends uppermost, and have axial grooves on the opposed surfaces forming regions to grind the material introduced between the surfaces. The cone members taper inwardly toward the top and at about the upper half the opposed surfaces of the cone members diverge while at about the lower half the opposed surfaces are substantially parallel. The cone members are relatively adjustable in the axial direction, particularly to control the size of the gap between the lower portions thereof. In operation, material to be ground is introduced between the cone members at the top and is reduced to flour along the upper portions of the members while along the lower portions of the members friction developed on the ground material causes it to become heated. The starch granules are mechanically ruptured during the milling and are not more than partially cooked during the aforementioned heating.

If the material is substantially dry, the milling and heating will not release substantial amounts of steam but if the material is moist, the heating of the material will convert at least some of the water to steam, assisting in the disintegration of the starch granules of the grain and possibly causing some cooking thereof.

External heat may be supplied to the apparatus, electrically, or by gas.

8 Claims, 7 Drawing Figures

METHOD AND APPARATUS FOR REDUCING STARCH-CONTAINING MATERIAL TO FLOUR

RELATED APPLICATION

This application is a continuation-in-part of U.S. Ser. No. 392,625, filed Aug. 29, 1973, now abandoned, entitled "METHOD AND APPARATUS FOR CONVERTING GRAINS INTO COOKED FLOUR", Inventor Fausto Celorio Mendoza.

The present invention relates to a highly water absorbent starch and to a method and apparatus for converting materials such as grains and beans and the like into such highly water absorbant starch and especially to such a method and apparatus in which no heated furnace as such is employed.

A great many grains and beans and like materials are converted into flour for use in foodstuffs and for industrial purposes, especially when a water absorbant material is needed. Also, certain vegetables can be converted into flours. It will be understood that the present invention is concerned with any material which contains starch granules and which is adapted for being processed into a flour for use in connection with foodstuffs and the industrial purposes referred to.

Heretofore, the conversion of grains and the like into flour was carried out in two steps with the pulverizing or grinding of the material being carried out in one step either by wet pulverizing or dry pulverizing with a further step being carried for the ground materials with heat thereby to cook and rupture the starch granules. Such processing of the materials requires at least two different devices and the carrying out of a series of steps and thus involves substantial time and labor and equipment cost.

With the foregoing in mind, the primary objective of the present invention is the provision of starch which is highly water absorbant and a method and apparatus for producing the starch which not only reduces such material to the desired consistency or particle size, but, furthermore, simultaneously effects mechanical rupturing of the starch grannules of the material.

A further object of the present invention is the provision of a single device in which material such as grain or the like can be dry ground into flour while simultaneously increasing water absorbancy thereof.

A still further object is the provision of a corn starch which is highly water absorbant and to a method and apparatus for producing such starch.

A further object is the provision of a mechanically ruptured starch granule which is substantially the same as a cooked starch granule in respect of water absorbancy.

BRIEF SUMMARY OF THE INVENTION

According to the present invention, elements in the form of truncated cones are provided in concentric relation, small ends uppermost, and with at least the inner cone being rotatable. The external surface of the inner cone and the interior surfaces of the outer cone are provided with axial grooves forming grinding surfaces on the cones and the material to be ground is introduced between the cones at the upper ends thereof and progresses downwardly therebetween.

The inner cone is axially adjustable in the outer cone for varying the gap therebetween thereby to control the amount of heat generated in the material being reduced as it moves downwardly in the device and also to control the fineness of the particles produced.

Advantageously, the cones are arranged on a vertical axis small end uppermost and the inner cone has a lower portion substantially parallel with the outer cone and an upper portion that diverges at a small angle from the upper cone and an uppermost end portion that is inclined inwardly at about 45° to form a portion of a feeding throat through which material to be reduced is introduced between the cones.

Raw material such as lentels, beans, wheat, corn, or the like, introduced between the cones at the upper end while the inner cone is rotating will be ground to flour therebetween with simultaneous rupturing of starch granules of the raw material while the heat generated in the material while between the cones will convert at least some of the moisture contained in the material to steam which, in addition to tending to partially cook the raw material, will cause swelling of the starch granules and will promote disintegration of the starch granules thereof. The ground flour which drops out from between the cones at the bottom will be, due to the substantially complete rupturing of the starch granules thereof, in a highly water absorbant condition.

The foregoing objects as well as still other objects and advantages of the present invention will become more apparent upon reference to the following detailed specification taken in connection with the accompanying drawings in which.

DETAILED DESCRIPTION OF THE INVENTION

Figure 1:
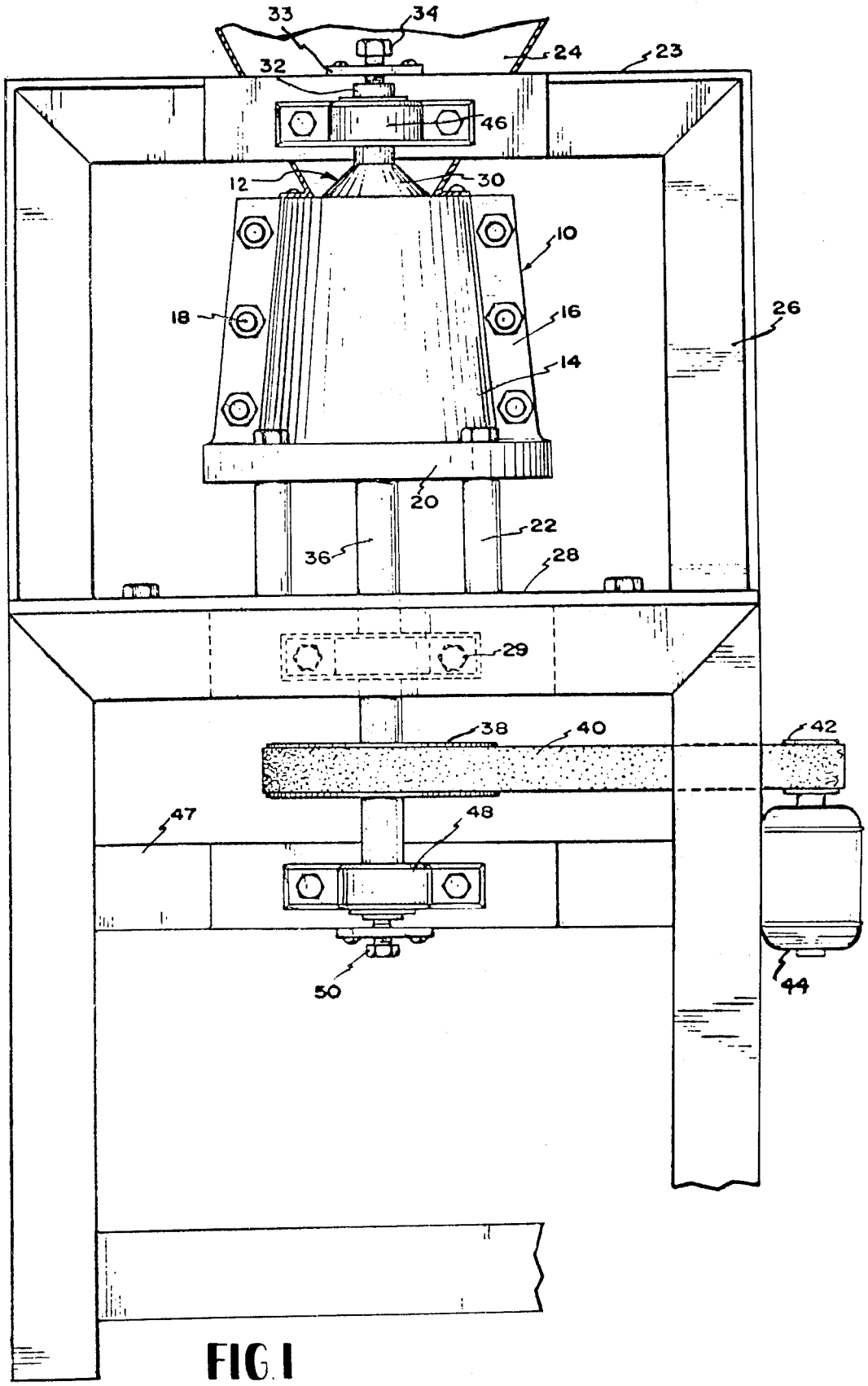
FIG. 1 is a front elevational view partly broken away showing a device according to the present invention.
Figure 2:
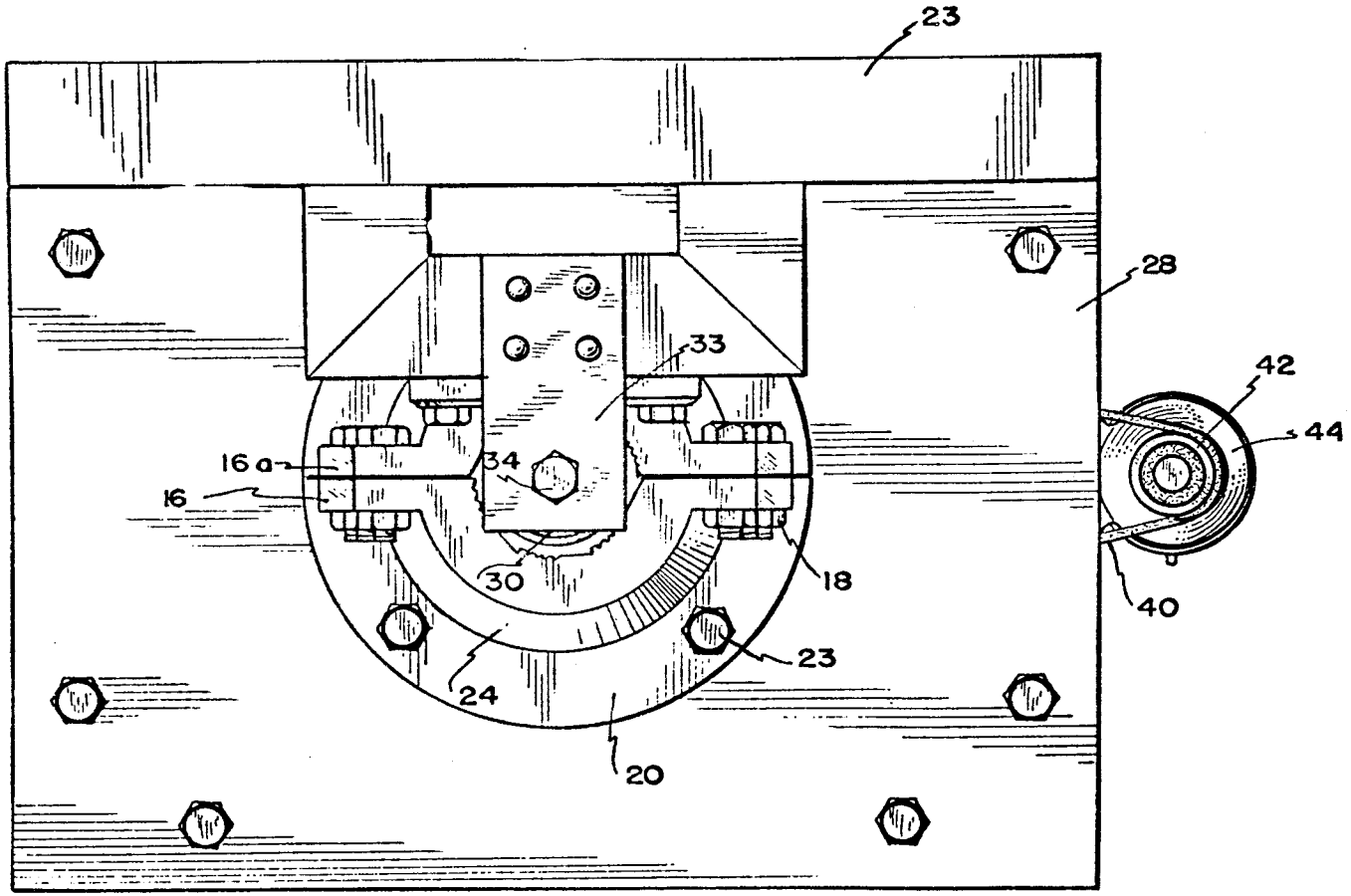
FIG. 2 is a plan view looking down on top of the device illustrated in FIG. 1.
Figure 5:
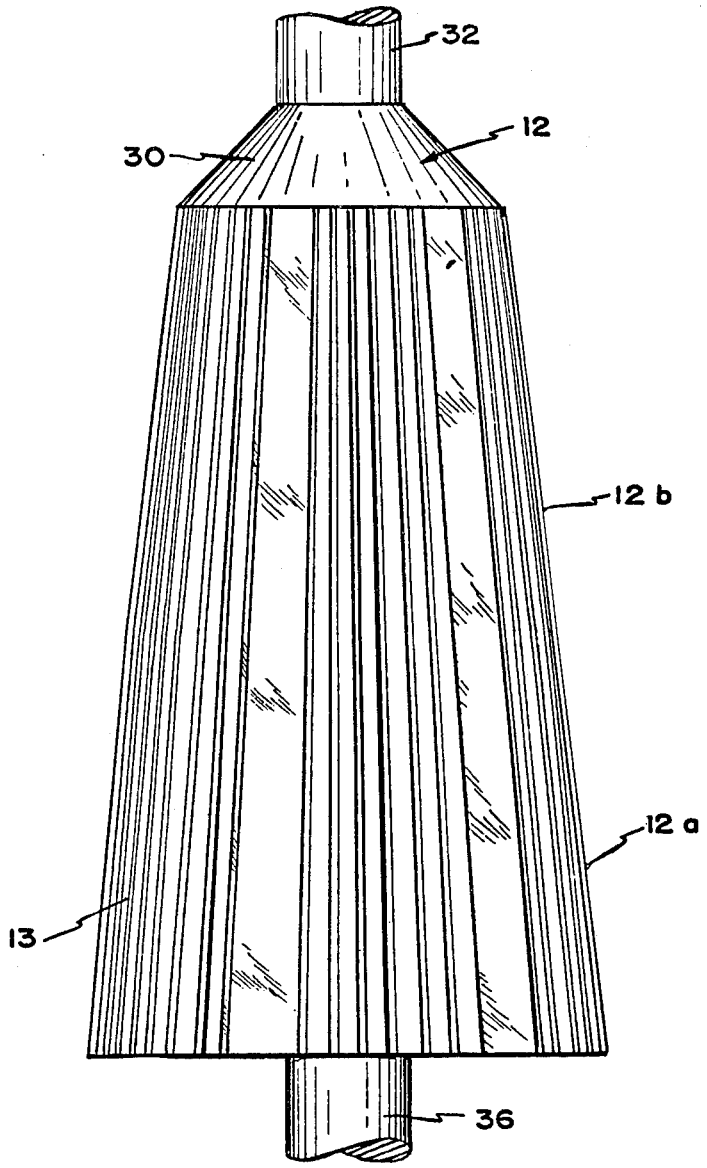
FIG. 5 is an elevational view of the inner cone of the reducing device and drawn at the same scale as FIGS. 3 and 4.
Figure 6:
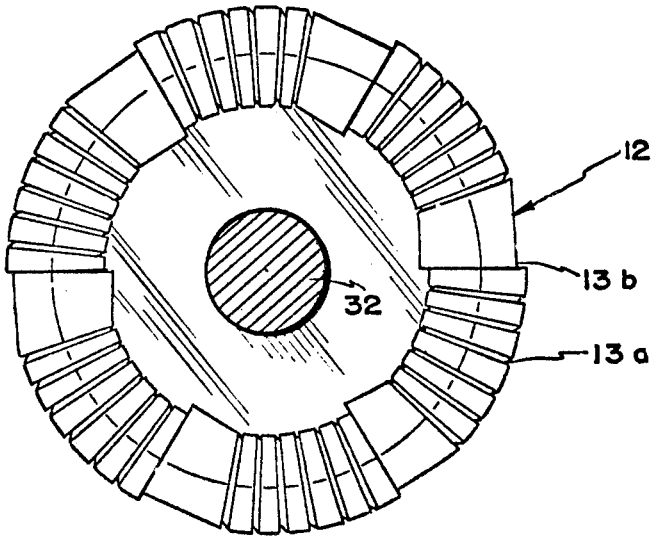
FIG. 6 is a plan view looking down on top of FIG. 5.

Referring to the drawings somewhat more in detail, and with particular reference to FIGs. 1 and 2, the device of the present invention, and which is generally indicated at 10, comprises a hollow outer member 14 in the form of a truncated cone and within which there is rotatable an inner member 12 also in the form of a truncated cone and shown more in detail in FIGs. 5 and 6. The cone members 12 and 14 are disposed smaller ends uppermost on a vertical axis.

Inner truncated cone member 12 has inwardly tapered upper portion 30 which surrounds a support shaft 32 which is rotatably journaled in a bearing 46 mounted in the frame 26 of the device. Shaft 32 is axially moveable and is abutted at the upper end by an adjustable bolt element 34 threaded in plate 33 carried by member 23 of the frame 26 of the device.

A hopper member 24 is provided at the upper end of the device and tapers inwardly toward the lower end and surrounds the inwardly tapering upper portion of inner truncated cone member 12. Hopper member 24 at the bottom is advantageously connected to the upper end of outer cone member 14.

At the bottom, inner truncated cone member 12 is connected to a shaft 36 which is rotatably supported in bearings 29 and 48 and at the bottom is abutted by the threaded abutment element 50. Abutment elements 50 and 34 are adjustable to determine the axial position of inner cone member 12 in outer cone member 14.

A pulley 38 connected to shaft 36 is engaged by a belt 40 which is entrained about the pulley 42 mounted on the output shaft of a drive motor 44 and which is mounted on the frame 26 of the device.

The outer cone member 14 is preferably fixedly supported in frame 26 as by posts 22 resting on cross member 28 of the frame and abutting flange 20 formed at the bottom of truncated cone member 14.

Similarly, the bearing 46 and member 33 in which abutment element 34 is threaded are advantageously carried on transverse member 33 at the top of frame 26.

Figure 3:
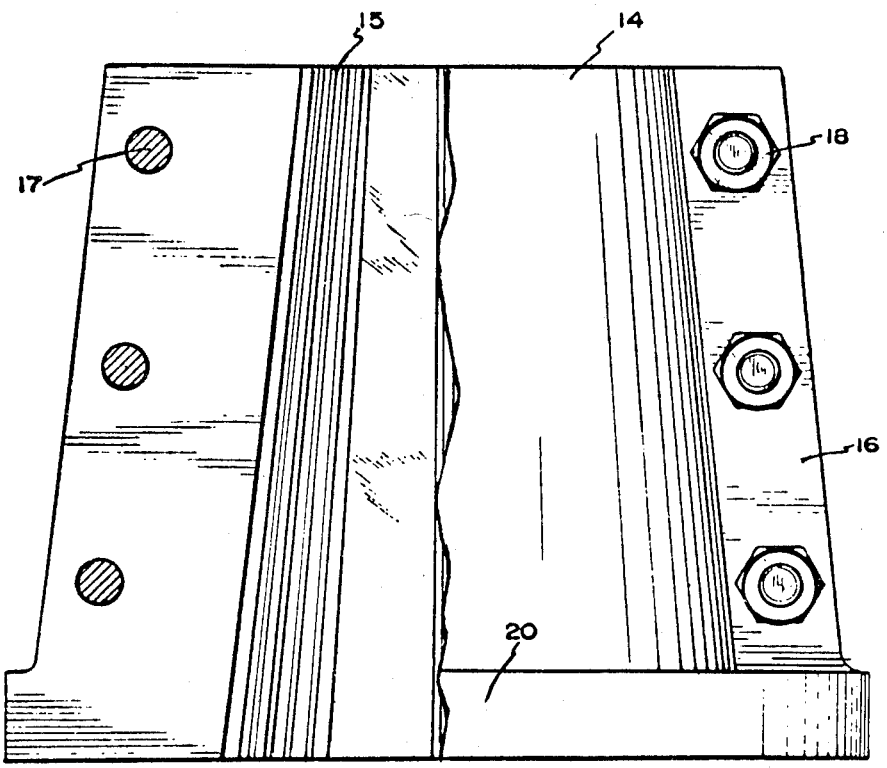
FIG. 3 is a front view partly broken away showing the outer cone of the reducing device and drawn at a larger scale then FIGS. 1 and 2.
Figure 4:
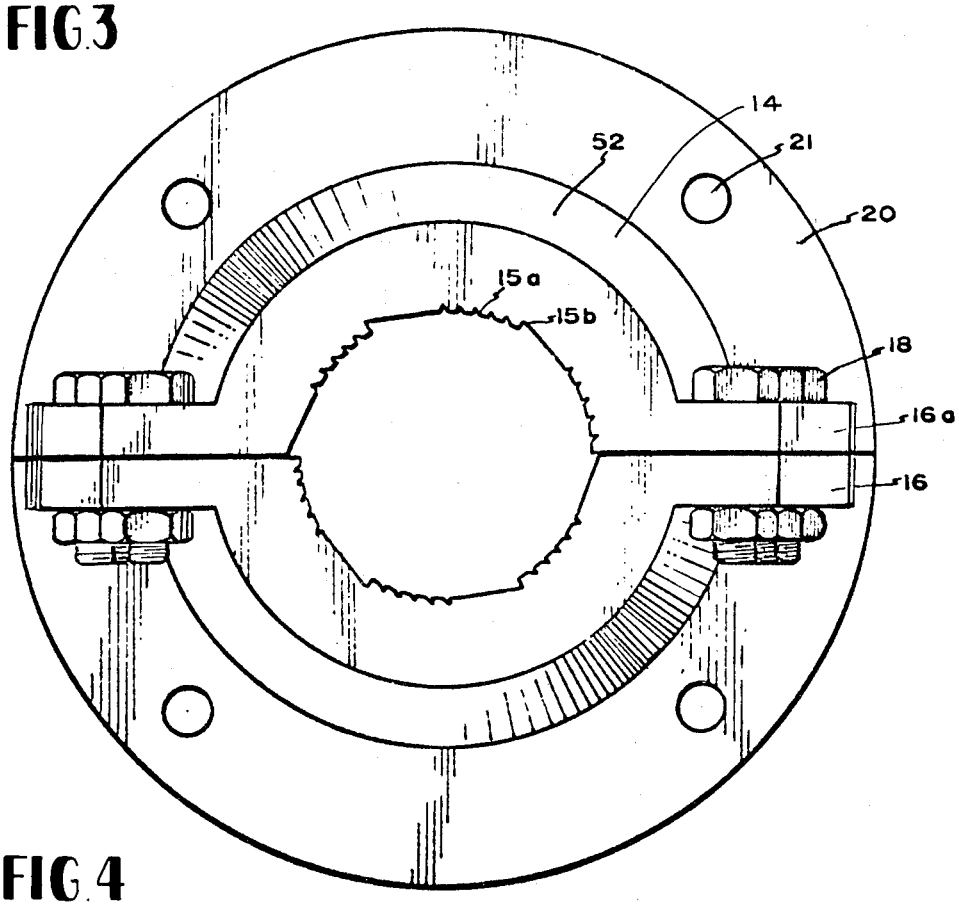
FIG. 4 is a view looking down on top of FIG. 3.

Referring more in detail to FIGS. 2, 3 and 4, it will be noted that truncated outer cone member 14 is separable along an axial plane of the cone member with the individual parts of the cone member having radial flanges 16 and 16*a* which have holes 17 therethrough through which bolts 18 are placed to clamp the two parts of the cone member 14 together.

Figure 7:
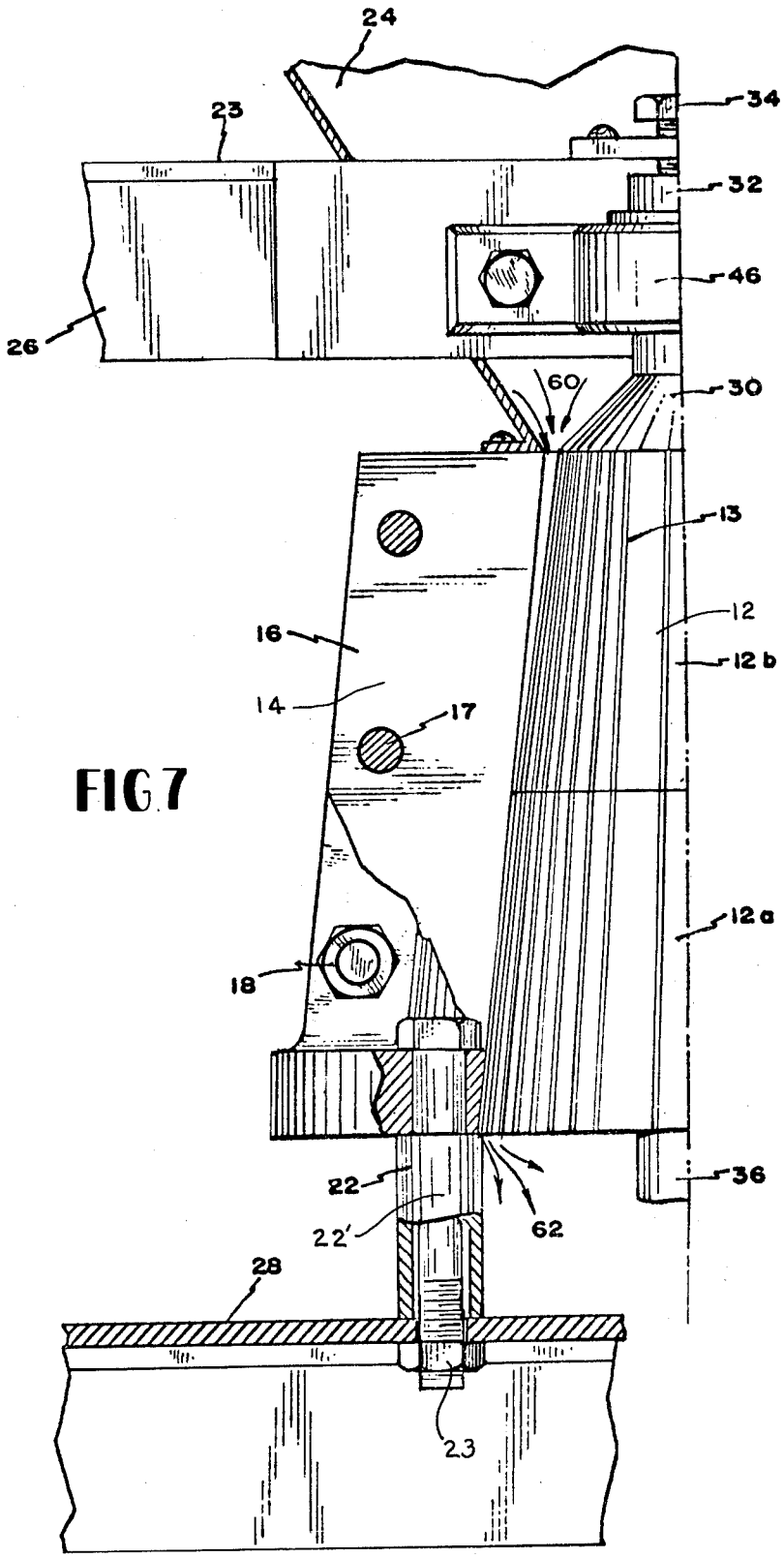
FIG. 7 is a fragmentary cross sectional view showing one side of the device and drawn at larger scale than FIGS. 1 and 2.

FIG. 4 will also show that flange 20 is provided with holes 21 through which the bolts extend that connect the cone member 14 to posts 22. As will best be seen in FIG. 7, posts 22 are traversed by bolts 22' which have nuts 23 fixed thereon on the underneath side of transverse rail 28 of the frame of the device.

The inside of outer cone member 14 is provided with grinding regions in the form of longitudinal grinding grooves 15*a* and feeding grooves 15*b* with ribs between the grinding grooves, the grinding regions are distributed about the inside of the outer cone on a somewhat spiral path.

The outer cone member 14 inclines uniformly inwardly from the bottom to the top, as indicated at 52, and as will be seen from FIGS. 3 and 4. It will also be seen that the grinding grooves and the ribs therebetween vary in coarseness in the circumferential direction as will best be seen in FIG. 4.

The inner cone member 12 is illustrated in FIGS. 5 and 6 and will be seen to comprise a solid member with the outer surface comprising a lower portion 12*a* and an intermediate portion 12*b*. Each portion 12*a*, 12*b*, is about half the length of cone member 12. Portion 12*a* is substantially parallel to the inner surface of outer cone member, but may incline inwardly at a slightly greater angle than the inner surface of the outer cone member in order to cause the path through which material flows to decrease in cross sectional area toward the bottom of the cones. As will be seen in FIG. 7, however, lower portion 12*a* of inner cone 12 is parallel to the inside of the outer cone member 14.

The intermediate portion 12*b* of the inner cone member, however, diverges from the inner side of the outer cone member 14 in the upper direction, thus, giving a flowpath that tapers inwardly in the downward direction to about the middle of the length of lower cone member 12.

The upper portion of the inner cone member 12, as mentioned, tapers inwardly at an angle of about 45° and cooperates with hopper 24 to form the feed throat that directs material supplied to the hopper 24 into the annular grinding path disposed between the inner and outer cone members.

The inner cone member is, similarly to the outer cone member, provided with grooves 13*a* and 13*b*, the latter forming feed veins similarly to the grooves 15*b* described in connection with FIG. 4.

when material such as grain or beans or the like is placed in hopper 24, it enters the grinding path at 60 and moves downwardly by gravity between the inner cone member and outer cone member while the inner cone member is driven in rotation. The material in passing downwardly between the cone members will be reduced in a more or less gradual manner by the grinding region on the members until it approaches the juncture of portions 12*a* and 12*b* of the inner cone member.

During the movement downward of the grain along the lower portion 12*a* of the inner cone member, there is not too much reduction of particle size of the product, but heat is developed in the material thereby creating the necessary temperature to vaporize water in the grains and cause rupturing of starch granules by a part of explosion. The material may be heated to a temperature ranging up to about 200° C. Also, a substantial amount of mechanical rupturing of starch granules takes place during movement of the grain through the mill.

The rupturing of starch granules will be carried out substantially throughout the length of lower portion 12*a* so that the product that drops out from between the cone members at the bottom, as indicated at arrows 62, is in a highly water absorbant state and ready for being utilized in food and for other purposes.

The flour will accumulate in the space beneath the lower ends of the cone members and can be extracted therefrom in any suitable manner from between spaced posts 22.

Either one or both of the milling members may be heated from an outside source, as by gas or electric heating means. An electric heater on one side of the outer milling member is shown schematically by the rectangle at 70 in FIG. 1. Rectangle 70 could also indicate a gas burner having flames directed toward the adjacent milling member.

It will be apparent that the present invention provides a method and apparatus in which grain such as corn or beans or the like can be converted directly into flour in a single apparatus in a single pass therethrough. It is apparent that the process according to the present invention results in saving of water, and fuel and avoids time consuming labor and complicated equipment while, at the same time, pollution or contamination of the environment is eliminated.

It might be pointed out that axial adjustment of the inner cone in the outer cone influences the fineness of the product produced but such adjustment of the inner cone is effected primarily for obtaining the degree of friction in the material between the lower portion of the inner cone member and the outer cone member that is necessary to effect to develop the desired temperature in the material being processed.

During the assays and tests made on the flour obtained in the process of the present invention, it was found that the iodine color test for determination of the water absorbancy of the starch did not indicate the starch to be cooked sufficiently to explain its extreme water-absorbing power. This was unexpected because the starch in the less than fully cooked state as obtained from the process of the present invention should not be as absorbant of water as fully cooked starch.

Upon detailed study, however, it was discovered that by milling corn or the like grains according to the process of the present invention, a certain degree of mechanical "damage" was introduced into the granules of starch present in the flour. This damage was determined to be the mechanical rupturing of the starch granules, due to the high pressure and friction developed during the dry-milling of the grain.

Although cooking of a grain produces in the starch granules thereof certain kind of damage, such damage, the amount and the nature thereof is quite different from the mechanical damage imparted to the grain by the process of the present invention. The mechanical damage referred to is, thus, a kind of damage not previously obtained.

In fact, the damage produced in the starch granules during the practice of the present invention could only amount to one-half of the damage expected to be produced through cooking, in order to obtain the same degree of water absorbancy in the starch. Further, the mechanical damage more resembles a "rupturing" of the granules than a scorching thereof, as results in the case of cooking of the granules.

Although I do not desire to be bound by any theory in particular, it is believed that the aforesaid damage is due mainly to two different influences occurring during the milling of the grain. First, the attrition or reduction of the grain to the flour under water-free, substantially dry conditions, determines that a certain amount of heat will be produced in the grain, but not enough to cook (i.e. to scorch) the flour.

Second, the heat thus produced is sufficient to disintegrate the granules by a chain of "explosions" induced by the moisture contained in the grain itself which, upon heating, is almost instantaneously converted into hot vapor, thus, increasing greatly its volume and materially "exploding" every granule.

From the foregoing considerations, it can be seen that a process is provided, consisting of the steps of supplying a grain, such as corn, to a grinding means; pulverizing the grain under hot conditions; converting the moisture of the grain particles into hot vapor under friction and pressure provided by said grinding members, and mechanically rupturing the starch granules of the thus obtained flour, under the action of the hot vapor and the attrition from the grinding means; thus providing a starch granule ruptured or damaged to such a degree that a high water absorbancy is developed in said grain, at least equal to, and preferably greater than, the water absorbancy developed by an actual cooking of the flour.

The thus produced starch, with damage or rupturing of the granules thereof, can be employed, in a number of application fields, such as, an adhesive for use in thickening oil well drilling muds, as a binder in charcoal briquets, as a foundry corebinder, in all of which applications the absorbing property thereof is excellent. The material is, of course, also usable in foodstuffs.

It will be evident that the disclosed apparatus could be employed to produce a substantially fully cooked flour if sufficient heat is supplied from externally of the apparatus and sufficient moisture is present in the treatment zone.

In any case, whether the flour emerges uncooked, or partially cooked, or fully cooked, it will be highly water absorbant with all, or substantially all, of the starch granules thereof ruptured.

Vapor released from the starch during the milling process will be picked up by the flour as the starch granules rupture but will not saturate the now highly water absorbant starch granules.

Modifications may be made within the scope of the appended claims.

What is claimed is:

1. A device for reducing starch-containing material to flour while simultaneously rupturing the starch granules therein comprising, in combination, truncated inner and outer cone members mounted on a common vertical axis, said inner cone member having a first series of closely spaced grinding grooves on the outer surface thereof, a first feed groove disposed between each first series of grinding grooves for feeding the starch-containing material to the grinding grooves, said outer cone member having a second series of closely spaced grinding grooves on the inner surface thereof, a second feed groove disposed between each second series of grinding grooves on said outer cone member for feeding the starch-containing material to the grinding grooves, said first and second feed grooves having a depth larger than the grinding grooves, said cone members being substantially coextensive in the axial direction, hopper means for supplying starch-containing material to be ground to the annular space between said cone members at the upper end for movement therebetween, said inner cone member having an inwardly tapering upper end disposed in the bottom of said hopper and forming therewith a feed throat leading to the annular space between said cone members, and motor means for driving at least one of said cone members in rotation.

2. A device according to claim 1 in which the opposed surfaces of said cone members are substantially parallel along the lower region of said cone members and diverge along the upper region thereof.

3. The method of reducing starch-containing material to flour while simultaneously rupturing the starch granules therein comprising the steps of supplying the starch-containing material to the space between a pair of relatively movable vertically disposed grinding members for gravity flow of the starch-containing material between the members wherein the starch-containing material is reduced to flour in a substantially dry condition in the upper position of the grinding members and converting the moisture contained in the starch-containing material into hot vapor by attrition in the lower position of the grinding members to disintegrate the granules of the starch-containing material thus increasing its volume, mechanically rupturing the starch granules of the starch-containing material under the action of the hot vapor and the attrition from he grinding members thereby providing a starch granule ruptured to such a degree that a high water absorbency is developed in the starch-containing material at least equal to the water absorbency developed by an actual cooking of the starch-containing material.

4. The method according to claim 3 in which the starch-containing material is heated to a temperature ranging up to about 200°C.

5. The method according to claim 3 which includes supplying heat to at least one of said grinding members from an external source.

6. The method according to claim 3 which includes cooling said starch-containing material before it leaves the space between said grinding members whereby the ground starch-material material absorbs at least a part of the moisture driven therefrom while the material was hot.

7. The method according to claim 3 in which the starch-containing material moves along an inwardly tapering path during the reduction thereof to flour and then moves along a constricted path during the development of heat thereon.

8. The method according to claim 7 which includes varying the degree of constriction of the constricted path to vary the amount of heat developed in the starch-containing material.

* * * * *

UNITED STATES PATENT OFFICE

CERTIFICATE OF CORRECTION

Patent No. 3,930,878 Dated January 6, 1976

Inventor(s) Fausto Celorio Mendoza

It is certified that error appears in the above-identified patent and that said Letters Patent are hereby corrected as shown below:

Col. 1, line 61 "surfaces" should be --- surface ---.

Col. 3, line 17, "of" should be --- on ---.

Col. 6, line 53 (Claim 3) "he" should be --- the ---.

Signed and Sealed this twenty-second Day of June 1976

[SEAL]

Attest:

RUTH C. MASON
*Attesting Officer*

C. MARSHALL DANN
*Commissioner of Patents and Trademarks*